US009333438B2

(12) United States Patent
Lee et al.

(10) Patent No.: US 9,333,438 B2
(45) Date of Patent: May 10, 2016

(54) BLOCK STUDYING TOOL FOR INFANT

(71) Applicants: Sang Kil Lee, Seoul (KR); Young Soon Kim, Yongin-si (KR)

(72) Inventors: Sang Kil Lee, Seoul (KR); Young Soon Kim, Yongin-si (KR)

( * ) Notice: Subject to any disclaimer, the term of this patent is extended or adjusted under 35 U.S.C. 154(b) by 0 days.

(21) Appl. No.: 14/702,105

(22) Filed: May 1, 2015

(65) Prior Publication Data

US 2015/0343320 A1 Dec. 3, 2015

(30) Foreign Application Priority Data

May 30, 2014 (KR) ..... 10-2014-0066013

(51) Int. Cl.
*A63H 33/08* (2006.01)
*A63H 33/06* (2006.01)

(52) U.S. Cl.
CPC ..... *A63H 33/065* (2013.01); *A63H 33/086* (2013.01)

(58) Field of Classification Search
USPC ..... 446/117, 118, 120, 121, 122, 124
See application file for complete search history.

(56) References Cited

U.S. PATENT DOCUMENTS 3,236,004 A * 2/1966 Christiansen ..... A63H 33/042 384/420
3,566,531 A * 3/1971 Hasel ..... A63H 33/062 446/120
4,176,493 A * 12/1979 Dideriksen ..... A63H 33/042 446/102
5,306,198 A * 4/1994 Forman ..... A63F 9/0098 446/116
5,453,034 A * 9/1995 Larws ..... A63H 33/062 446/103
5,853,314 A * 12/1998 Bora ..... A63H 33/086 446/102
6,050,044 A * 4/2000 McIntosh ..... A63H 33/086 446/124
6,645,033 B1 * 11/2003 Thomsen ..... A63H 33/086 446/120
6,648,715 B2 * 11/2003 Wiens ..... A63H 33/062 446/121
8,690,631 B2 * 4/2014 Nag ..... A63H 33/042 446/125
2010/0203796 A1 * 8/2010 Beg ..... A63H 33/086 446/120

FOREIGN PATENT DOCUMENTS

KR 20-0418966 Y1 6/2006
KR 10-0824585 B1 4/2008
KR 10-2012-0038842 A 4/2012
KR 20-2013-0003402 U 6/2013

* cited by examiner

*Primary Examiner* — Kurt Fernstrom
(74) *Attorney, Agent, or Firm* — Rabin & Berdo, P.C.

(57) ABSTRACT

A block studying tool for an infant, includes: a block body having a hexahedral shape, a lower portion of which is opened; and a plurality of unit assembling portions disposed to protrude from an upper portion of the block body upward and disposed to be spaced a predetermined distance apart from each other, wherein a divider is disposed at an inside of the lower portion of the block body and forms an assembling space in which the plurality of unit assembling portions of the adjacent block body are to be assembled according to positions.

4 Claims, 13 Drawing Sheets

BLOCK STUDYING TOOL FOR INFANT

CROSS-REFERENCE TO RELATED APPLICATION

This application claims priority to and the benefit of Korean Patent Application No. 2014-0066013, filed on May 30, 2014, the disclosure of which is incorporated herein by reference in its entirety.

BACKGROUND

1. Field of the Invention

The present invention relates to a block studying tool for an infant, and more particularly, to a block studying tool for an infant, in which a simple stacking play in a straight line and a slantly-stacking play can be performed so that sculptures having various shapes can be assembled.

2. Discussion of Related Art

Block studying tools for infants are studying tools that have a very simple shape and perform a stacking play in a desired shape, unlike complicated blocks.

It is known that commonly-used block studying tools for infants are usually manufactured to promote intelligence development of children of 1 to 5 years or mentally retarded, handicapped children having mental ages corresponding to 1 to 5 years (hereinafter, referred to as infants).

These block studying tools for infants are stacked in various shapes so that sculptures having various shapes, such as architecture sculptures, can be assembled. By repeatedly performing this procedure, infants' ability to think and inquiry skills can be improved.

In addition, assembling and disassembling are repeatedly performed so that attentiveness, an ability to observe, organizing power, understanding, creativity, and practical ability, which are required for cognitive development, can be improved.

Meanwhile, since, as described above, these block studying tools for infants are applied to infants, they should not be complicated, and in particular, should be very easily assembled and disassembled.

Otherwise, that is, when block studying tools have a structure in which blocks cannot be easily assembled and disassembled, infants may get irritated when assembling blocks, which may cause an adverse effect of education. Even when blocks are very easily assembled, the adverse effect of education may be shown. Thus, an appropriate difficulty level of assembling is required for block studying tools.

However, in block studying tools for infants according to the related art, a simple stacking play can be performed in a height direction, i.e., in a straight line, and a slantly-stacking play cannot be easily performed, and due to a structural limitation of a block studying tool for an infant, assembling and disassembling are not easily performed. Thus, block studying tools for infants having an improved structure in consideration of the problems need to be developed.

PRIOR-ART DOCUMENT

Patent Document (Patent document 1) Korean Patent Application No. 10-2007-0050323

(Patent document 2) Korean Patent Application No. 10-2010-0100522

(Patent document 3) Korean Utility-model Application No. 20-2006-0009048

(Patent document 4) Korean Utility-model Application No. 20-2011-0010644

SUMMARY OF THE INVENTION

The present invention is directed to a block studying tool for an infant, in which a simple stacking play in a straight line and a slantly-stacking play can be performed so that sculptures having various shapes can be assembled and assembling is neither too easy nor too difficult so that an educational effect can be doubled.

According to an aspect of the present invention, there is provided a block studying tool for an infant, including: a block body having a hexahedral shape, a lower portion of which is opened; and a plurality of unit assembling portions disposed to protrude from an upper portion of the block body upward and disposed to be spaced a predetermined distance apart from each other, wherein a divider may be disposed at an inside of the lower portion of the block body and may form an assembling space in which the plurality of unit assembling portions of the adjacent block body are to be assembled according to positions.

Four unit assembling portions having a hexahedral shape may be disposed to be spaced apart from each other, and outer assembling protrusions may be formed to protrude from all of circumferential wall surfaces of the unit assembling portions, and outer assembling protrusion assembling grooves to be assembled with the outer assembling protrusions may be formed in inner sidewalls of the lower portion of the block body.

A shape of each of the outer assembling protrusions may be selected from the group consisting of a semi-pipe shape, a rectangular block shape, and a hemisphere shape, and the outer assembling protrusion assembling grooves may correspond to the outer assembling protrusions and may be formed to have larger sizes than the outer assembling protrusions.

Protrusions for doubling assembling strength may be formed on the divider of the block body and may be inserted into a space between the unit assembling portions so as to double assembling strength.

The divider may be disposed in a cross shape, and a reinforcement center boss may be formed at a central intersection point of the divider, may reinforce the divider, and may be disposed in empty spaces of center regions of the unit assembling portions.

Each of the unit assembling portions may have the same shape and the same volume, and edge regions of each unit assembling portion may be rounded.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
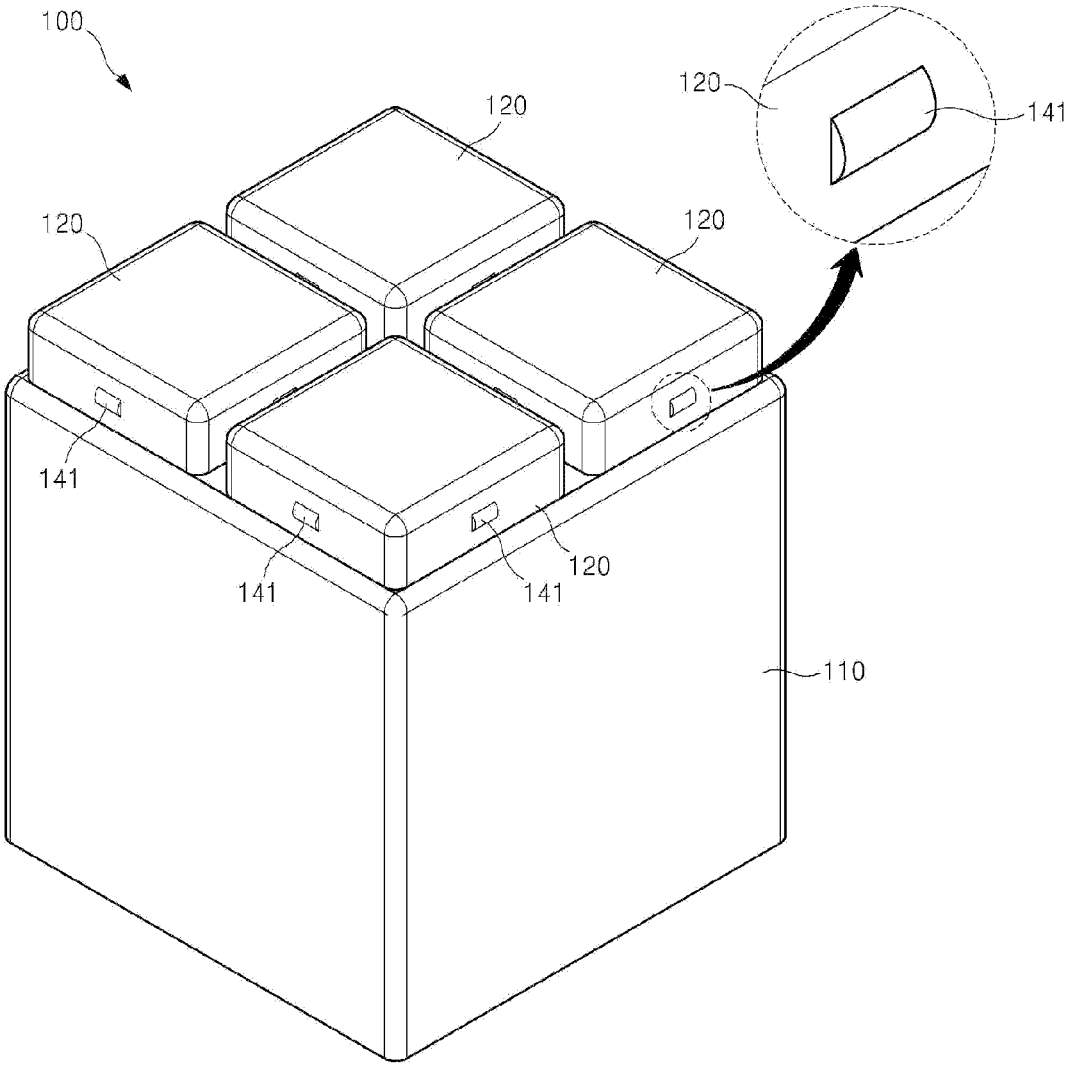
FIG. 1 is a front perspective view of a block studying tool for an infant according to a first embodiment of the present invention.

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

In some embodiments, well-known elements, well-known operations, and well-known technologies will not be specifically described so that the present invention may be prevented from being obscurely interpreted.

Like reference numerals are used for like elements throughout the specification. The terminology used (mentioned) herein is for the purpose of describing particular embodiments only and is not intended to be limiting of the invention.

As used herein, the singular forms are intended to include the plural forms as well, unless the context clearly indicates otherwise. It will be further understood that elements and operations mentioned as "comprises" and/or "comprising," do not preclude the presence or addition of one or more other elements and operations.

Unless otherwise defined, all terms (including technical and scientific terms) used herein have the same meaning as commonly understood by one of ordinary skill in the art to which this invention belongs.

It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the present invention will be described with reference to the attached drawings.

Figure 2:
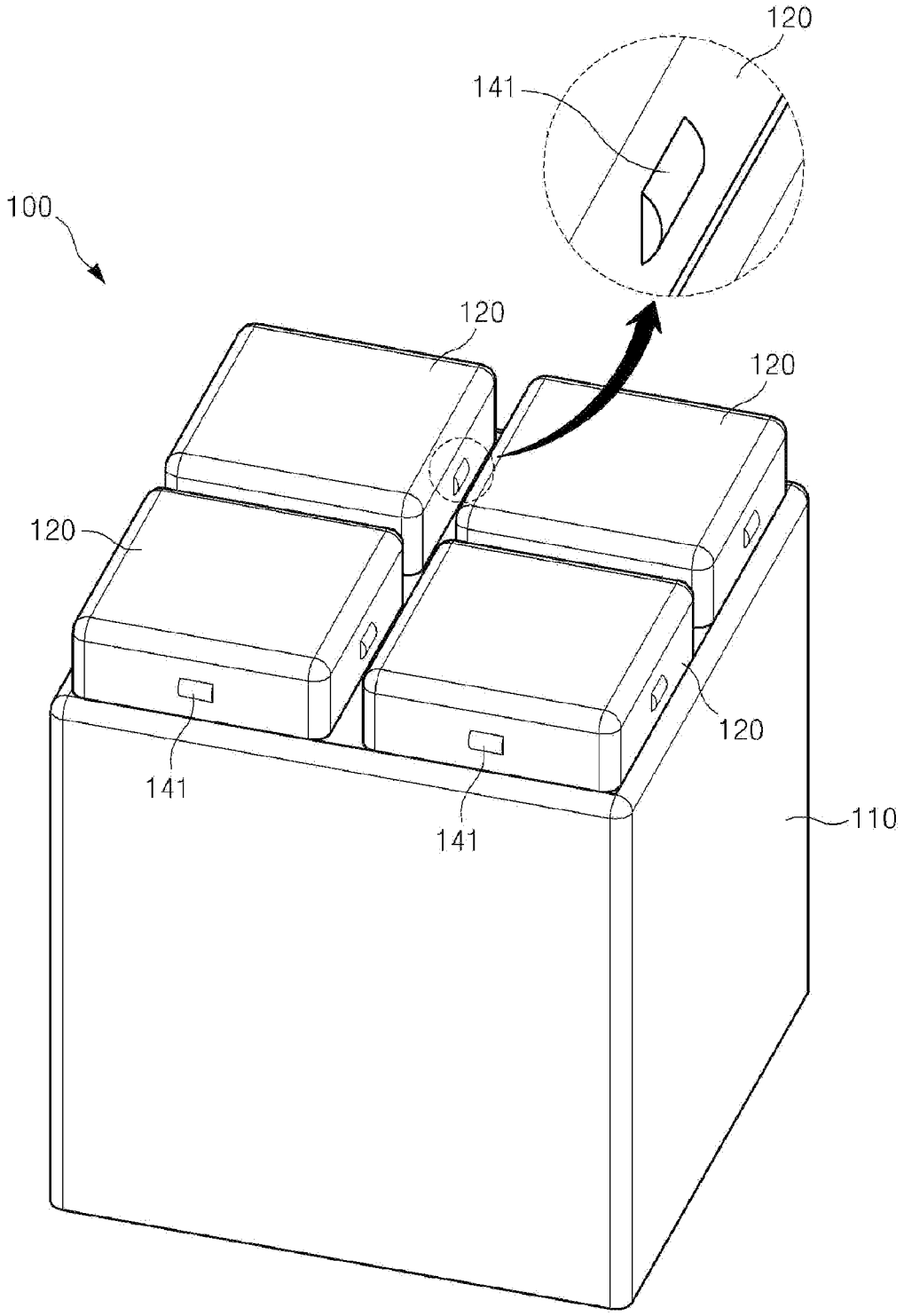
FIG. 2 is a view in a different direction of FIG. 1.
Figure 3:
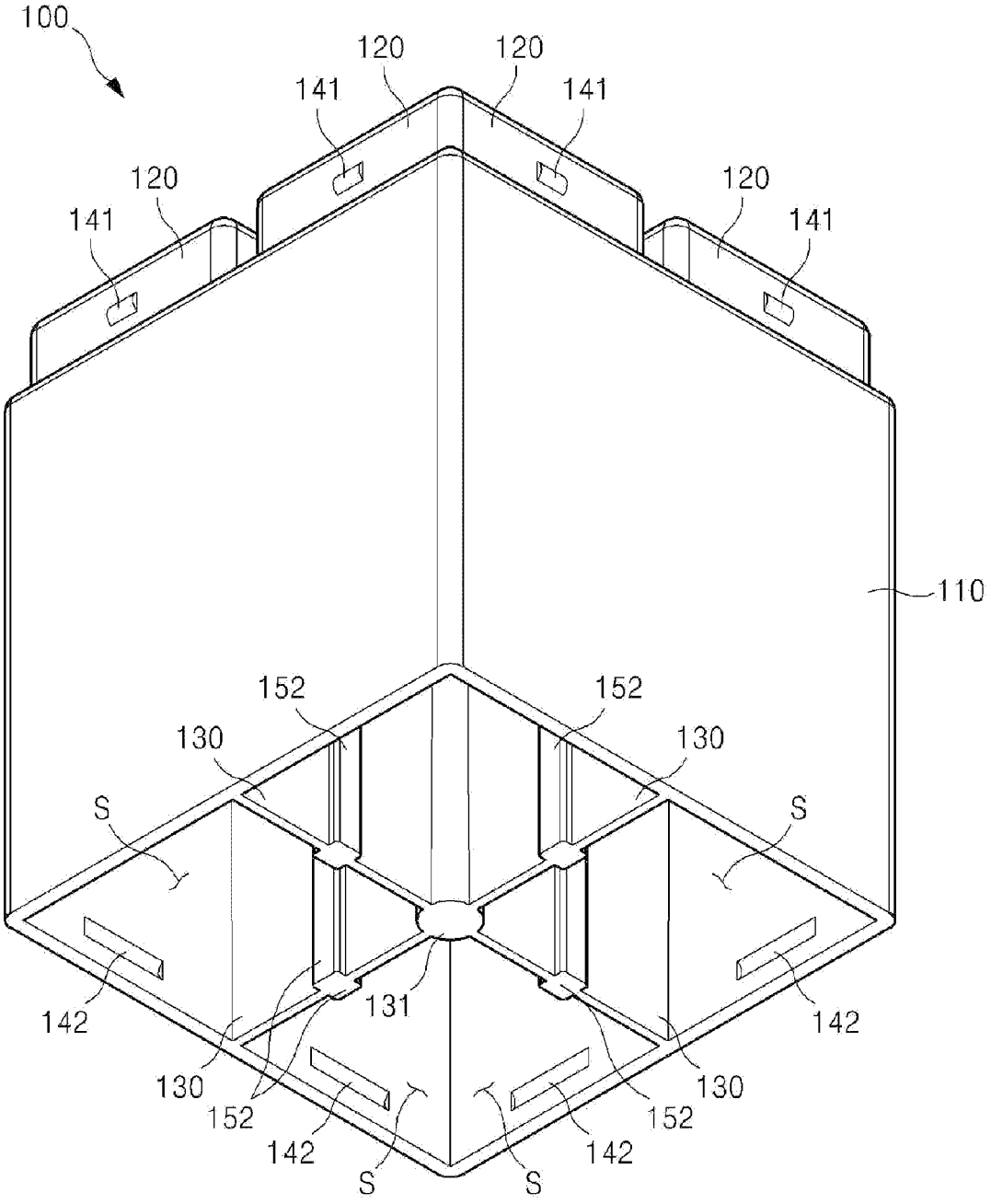
FIG. 3 is a rear perspective view of FIG. 1.
Figure 4:
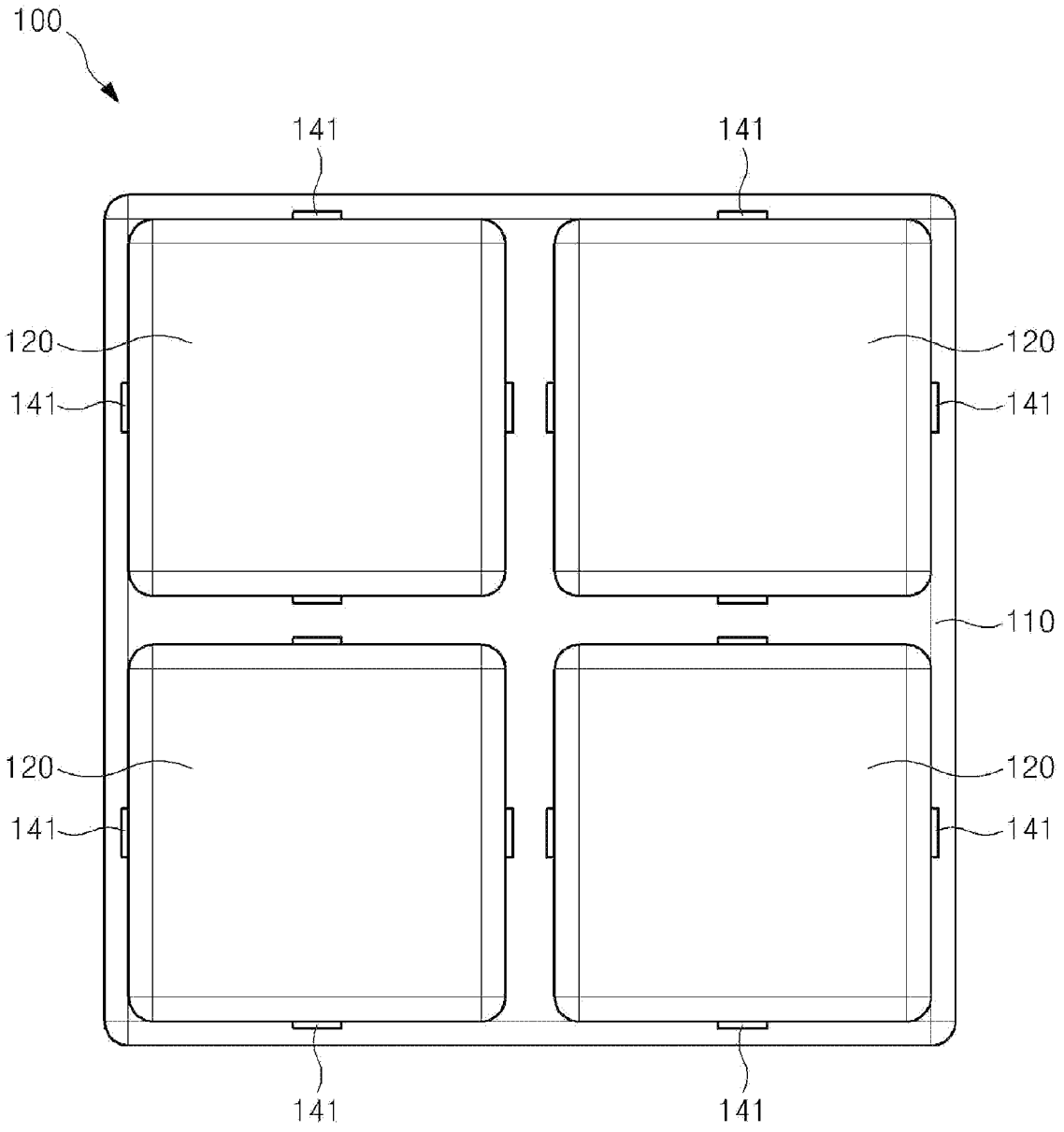
FIG. 4 is a plan view of FIG. 1.
Figure 5:
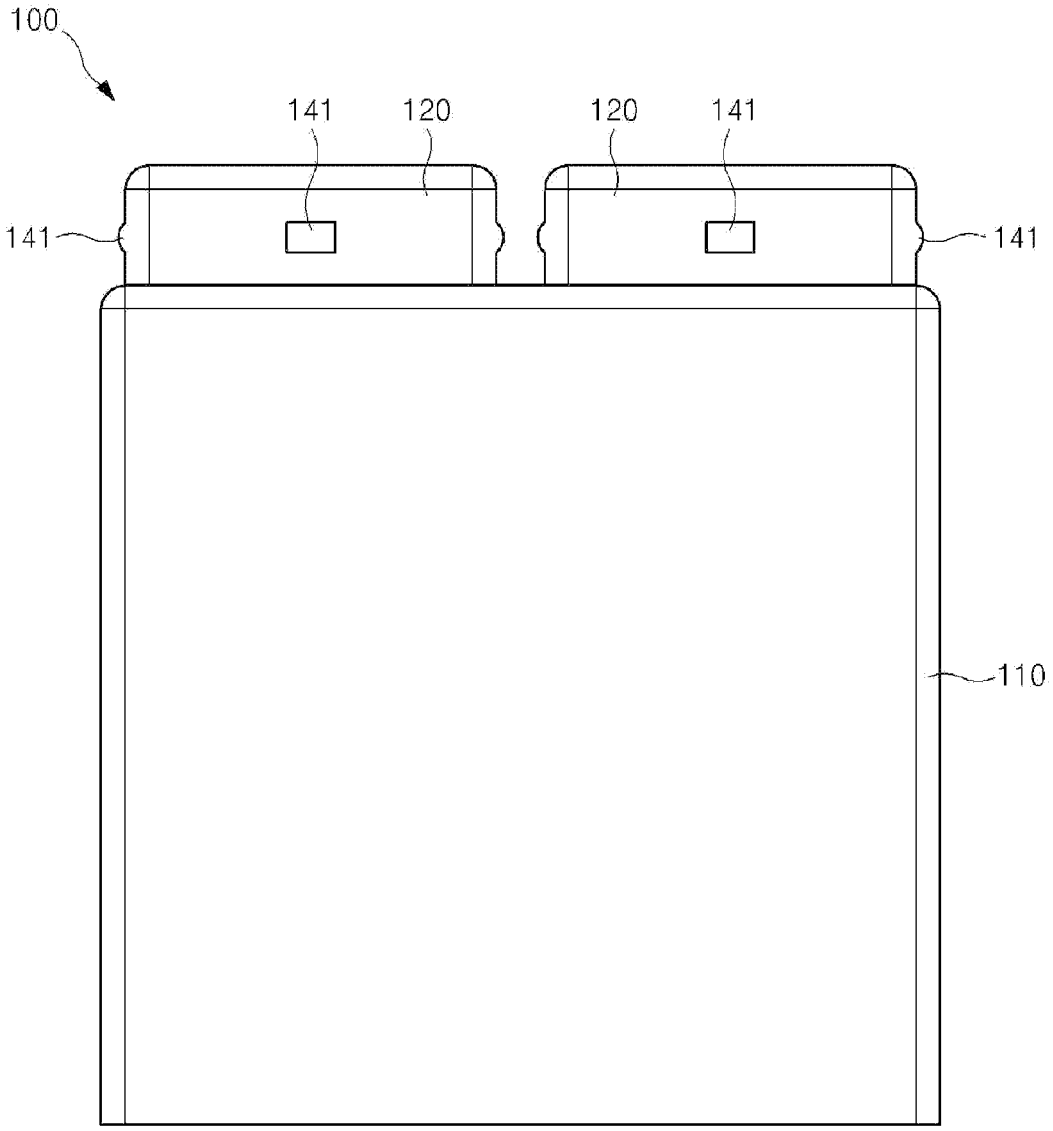
FIG. 5 is a side view of FIG. 4.
Figure 6:
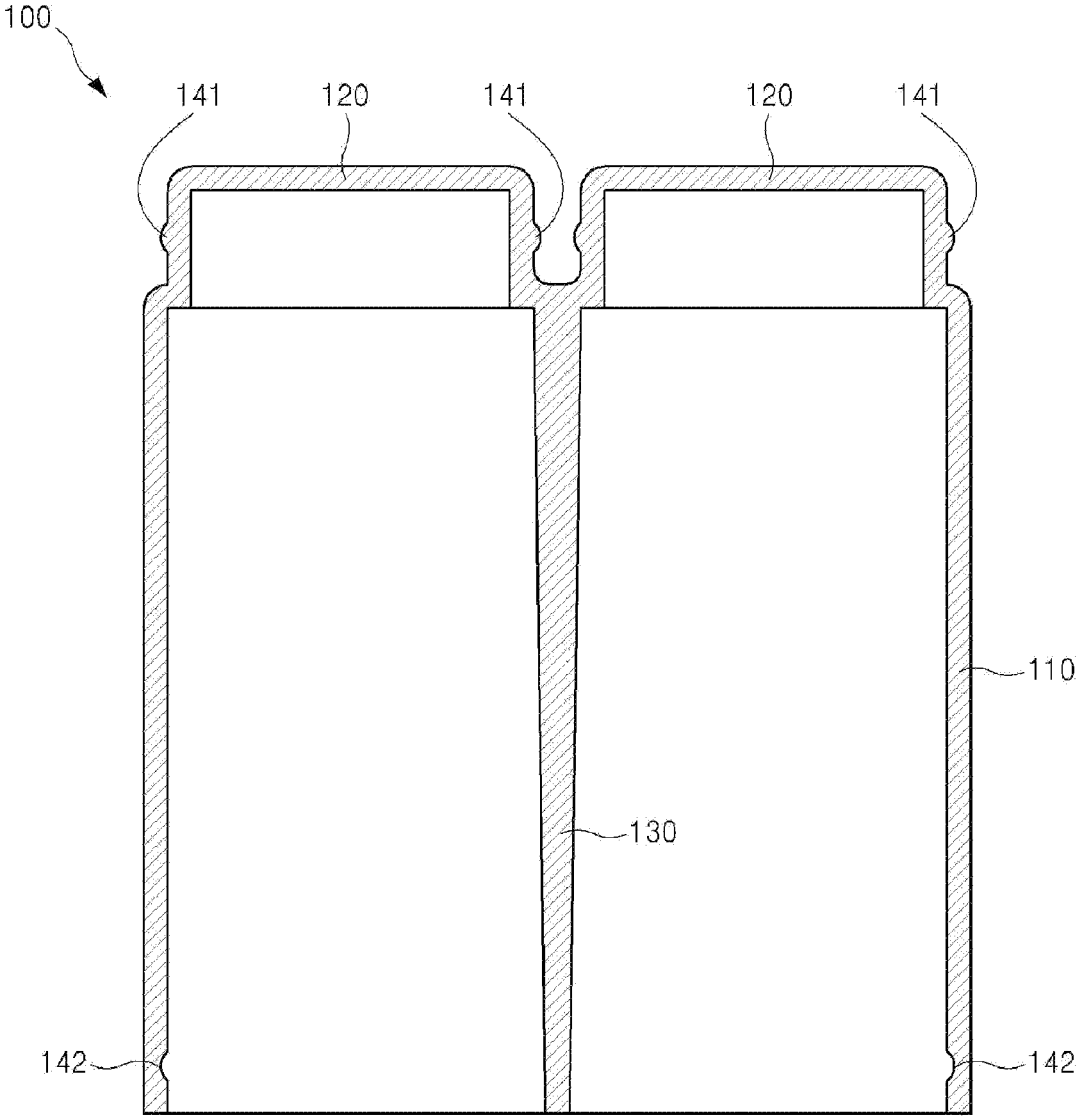
FIG. 6 is a cross-sectional view of FIG. 5.
Figure 7:
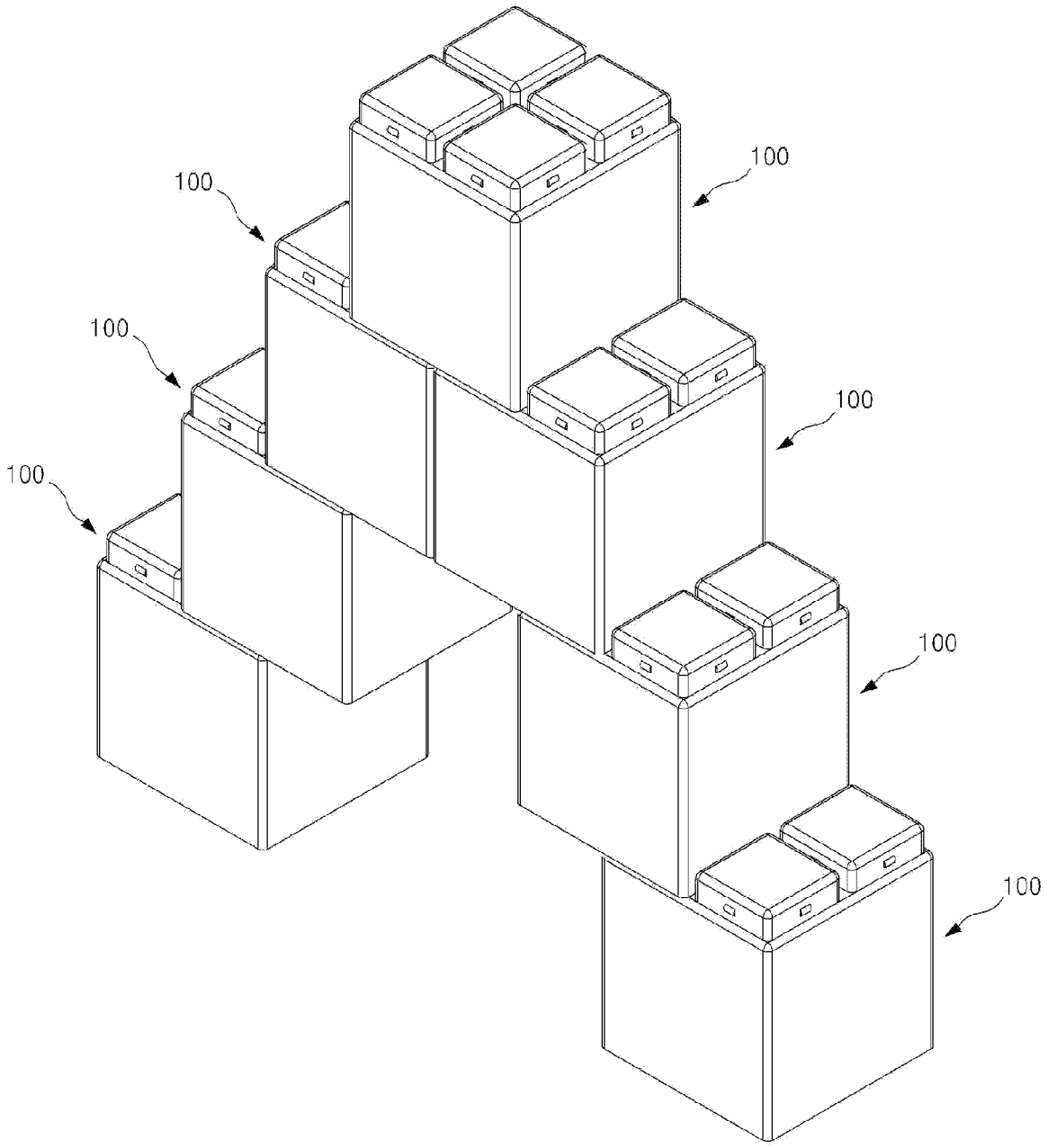
FIGS. 7 and 8 are views of sculptures assembled using the block studying tool for the infant illustrated in FIG. 1, respectively.
Figure 8:
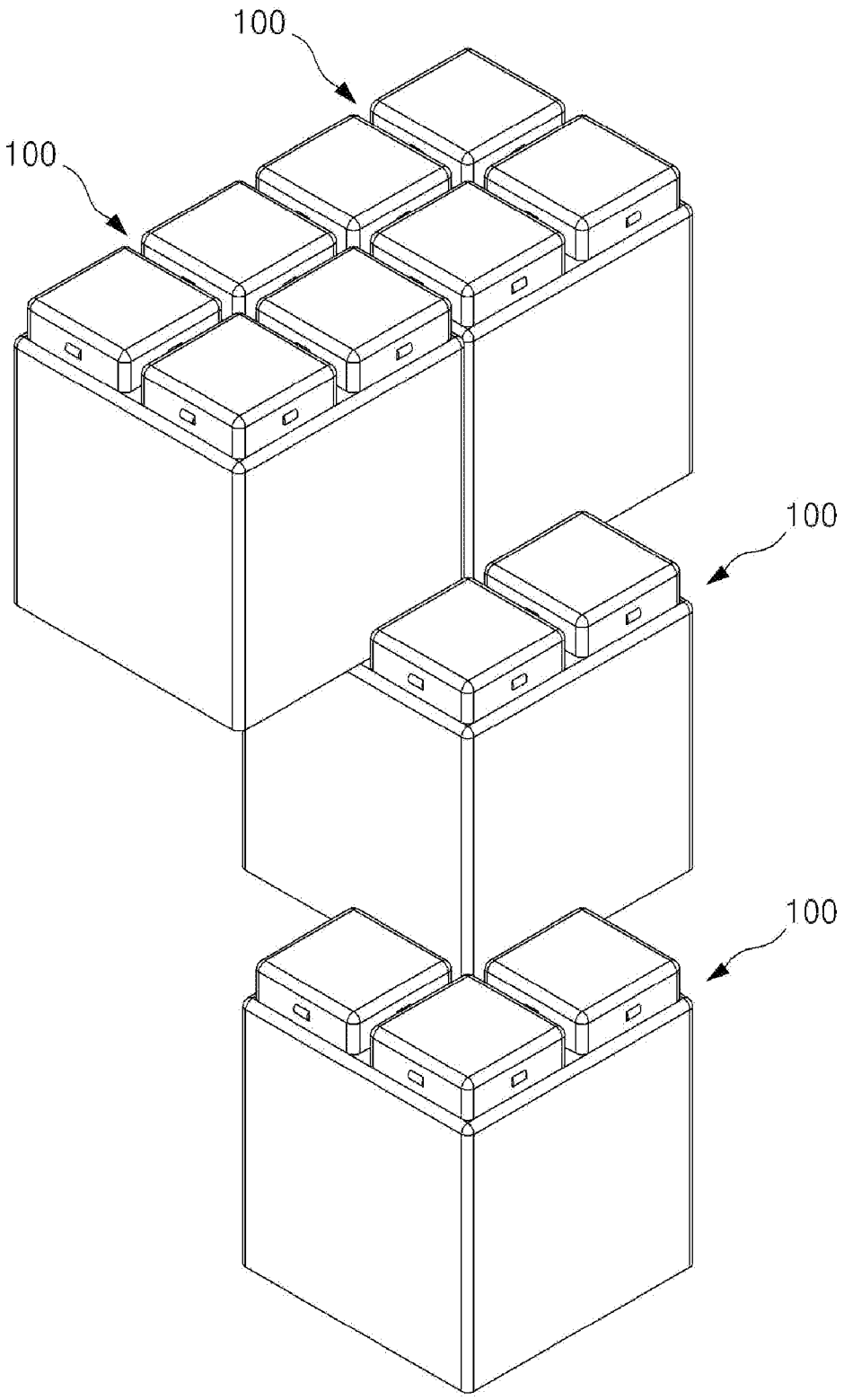

FIG. 1 is a front perspective view of a block studying tool for an infant according to a first embodiment of the present invention, and FIG. 2 is a view in a different direction of FIG. 1, and FIG. 3 is a rear perspective view of FIG. 1, and FIG. 4 is a plan view of FIG. 1, and FIG. 5 is a side view of FIG. 4, and FIG. 6 is a cross-sectional view of FIG. 5, and FIGS. 7 and 8 are views of sculptures assembled using the block studying tool for the infant illustrated in FIG. 1, respectively.

Referring to FIGS. 1 through 8, a block studying tool 100 for an infant according to the present embodiment, in which a simple stacking play in a straight line and a slantly-stacking play can be performed so that sculptures having various shapes can be assembled, has a hexahedral shape, an inside of which is empty.

The block studying tool 100 for the infant may be injection-molded using a non-toxic synthetic resin material considering that an infant may bring the block studying tool 100 toward his/her own mouth due to characteristics of the infant.

As described above, the block studying tool 100 for the infant is usually manufactured to promote intelligence development of children of 1 to 5 years or mentally retarded, handicapped children having mental ages corresponding to 1 to 5 years (hereinafter, referred to as infants) and thus has a noncomplicated, simple structure.

That is, the block studying tool 100 for the infant has a simple structure in which a plurality of, i.e., four unit assembling portions 120 are formed at an upper portion of a block body 110 having a hexahedral shape, a lower portion of which is opened.

Of course, the block studying tool 100 for the infant according to the present embodiment has the simple structure but enables a simple stacking play in a straight line and a slantly-stacking play so as to assemble sculptures having various shapes, unlike block studying tools for infants according to the related art.

In addition, due to an assembling structure that will be described later, assembling and disassembling are easily performed so that the infant can perform a stacking play without getting irritated. Thus, infant's ability to think and inquiry skills can be improved and attentiveness, an ability to observe, organizing power, understanding, creativity, and practical ability, which are required for infants' cognitive development, can be improved.

With respect to the structure of the block studying tool 100 for the infant that may provide this effect, the block body 110 that constitutes the exterior of the block studying tool 100 for the infant has a hexahedral shape, a lower portion of which is opened.

The block body 110 may also have a regular cube shape or rectangular parallelepiped shape.

A plurality of unit assembling portions 120 are disposed at the upper portion of the block body 110. Four unit assembling portions 120 each having a hexahedral shape may be disposed to be spaced apart from each other.

The plurality of unit assembling portions 120 protrude from the upper portion of the block body 110 upward and are disposed to be spaced a predetermined distance apart from each other.

In particular, each of the unit assembling portions 120 has the same shape and the same volume, and edge regions of each unit assembling portion 120 are rounded. Thus, the infant may be prevented from being injured by sharp edges.

Meanwhile, a divider 130 that forms an assembling space S in which the unit assembling portions 120 of the adjacent block body 110 are to be assembled according to positions, is disposed at an inside of a lower portion of the block body 110 that is a structure, a lower portion of which is empty.

Since, in the present embodiment, four unit assembling portions 120 are disposed at the upper portion of the block body 110 so as to be spaced apart from each other, four assembling spaces S are formed by the divider 130.

Of course, even though four unit assembling portions 120 and four assembling spaces S are formed, all of them are not assembled. That is, when a block stacking play is performed, the four unit assembling portions 120 and the four assembling spaces S may be assembled to correspond to each other. However, as illustrated in FIGS. 7 and 8, only some of the four unit assembling portions 120 and the four assembling spaces S may be assembled. As this assembling structure can be established, the block studying tool 100 for the infant according to the current embodiment enables a simple stacking play in a straight line and a slantly-stacking play so that sculptures having various shapes can be assembled.

The divider 130 is disposed in a cross shape. A reinforcement center boss 131 is formed at a central intersection point of the divider 130 disposed in the cross shape, reinforces the divider 130, and is disposed in empty spaces of center regions of the unit assembling portions 120.

Meanwhile, outer assembling protrusions 141 are formed to protrude from all of circumferential wall surfaces of the unit assembling portions 120, and outer assembling protrusion assembling grooves 142 to be assembled with the outer assembling protrusions 141 are formed in inner sidewalls of the lower portion of the block body 110 so that the sculptures stacked as illustrated in FIGS. 7 and 8 may not be arbitrarily easily separated from each other.

In the current embodiment, each of the outer assembling protrusions 141 has a semi-pipe shape, and the outer assembling protrusion assembling grooves 142 correspond to the outer assembling protrusions 141 and are formed to have larger sizes than the outer assembling protrusions 141. Since the outer assembling protrusion assembling grooves 142 are formed to have larger sizes than the outer assembling protrusions 141, assembling of the block studying tool 100 for the infant can be easily performed.

Also, protrusions 152 for doubling assembling strength are formed on the divider 130 of the block body 110 and are inserted into a space between the unit assembling portions 120 to double assembling strength. The protrusions 152 for doubling assembling strength protrude from the central region of the divider 130 toward both sides of the divider 130 to be symmetrical with each other and are long formed along a lengthwise direction of the block body 110. In other words, unlike the outer assembling protrusions 141, the protrusions 152 for doubling assembling strength are formed long in the form of a rail from the divider 130.

Since the protrusions 152 for doubling assembling strength are formed, as illustrated in FIGS. 7 and 8, even though only some of the four unit assembling portions 120 and the four assembling spaces S are assembled, assembling strength may be maintained at a uniform level. Thus, a phenomenon that slantly-stacked blocks will fall down due to weak assembling strength, can be fundamentally prevented.

By using the block studying tool 100 for the infant having the above-described structure, for example, by using seven block studying tools 100 for infants, a stacking play can be performed, as illustrated in FIG. 7, and by using four block studying tools 100 for infants, a stacking play can be performed, as illustrated in FIG. 8.

This stacking play can be performed by the plurality of unit assembling portions 120, a combination of the outer assembling protrusions 141 and the outer assembling protrusion assembling grooves 142, and a combination of the protrusions 152 for doubling assembling strength, as described above.

According to the present embodiment having the above structure and operation, a simple stacking play in a straight line and a slantly-stacking play can be performed so that sculptures having various shapes can be assembled. Also, assembling is neither too easy nor too difficult so that an educational effect can be doubled.

In addition, according to the present embodiment, assembling and disassembling are easily performed so that the infant can perform a stacking play without getting irritated. Thus, the infant's ability to think and inquiry skills can be improved, and attentiveness, an ability to observe, organizing power, understanding, creativity, and practical ability, which are required for infants' cognitive development, can be improved.

Figure 9:
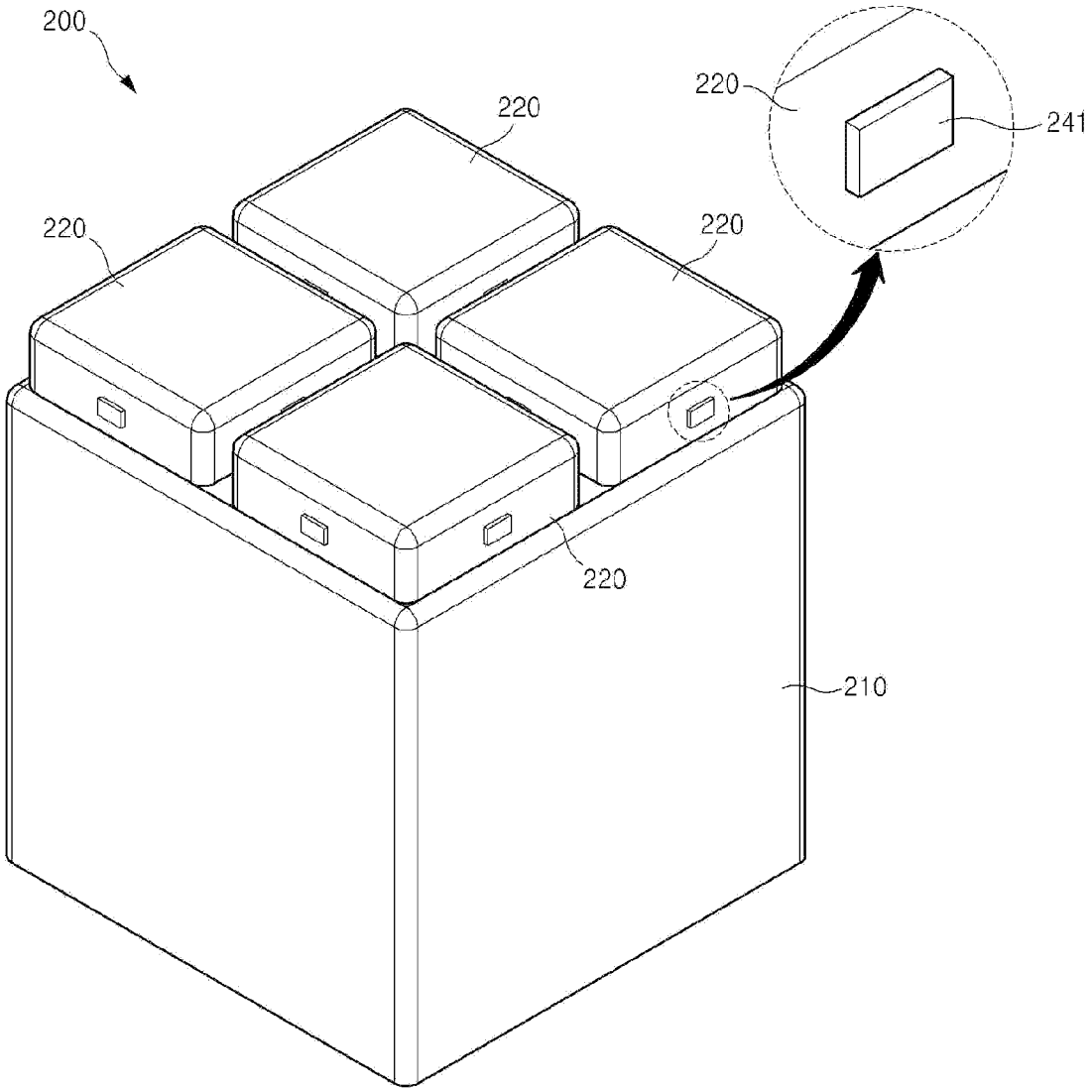
FIG. 9 is a front perspective view of a block studying tool for an infant according to a second embodiment of the present invention.

FIG. 9 is a front perspective view of a block studying tool for an infant according to a second embodiment of the present invention.

Referring to FIG. 9, a block studying tool 200 for an infant according to the present embodiment has a structure in which a plurality of unit assembling portions 220 having the same shape and disposed to be spaced apart from each other are integrally formed at an upper portion of a block body 210 having a hexahedral shape, an inside of which is empty.

In this structure, outer assembling protrusions 241 are formed in the form of rectangular blocks, unlike in the above-described embodiment.

Even when the block studying tool 200 for the infant according to the present embodiment is applied, a simple stacking play in a straight line and a slantly-stacking play can be performed so that sculptures having various shapes can be assembled. Also, assembling and disassembling can be easily performed so that the infant can perform a stacking play without getting irritated. Thus, the infant's ability to think and inquiry skills can be improved, and attentiveness, an ability to observe, organizing power, understanding, creativity, and practical ability, which are required for infants' cognitive development, can be improved.

Figure 10:
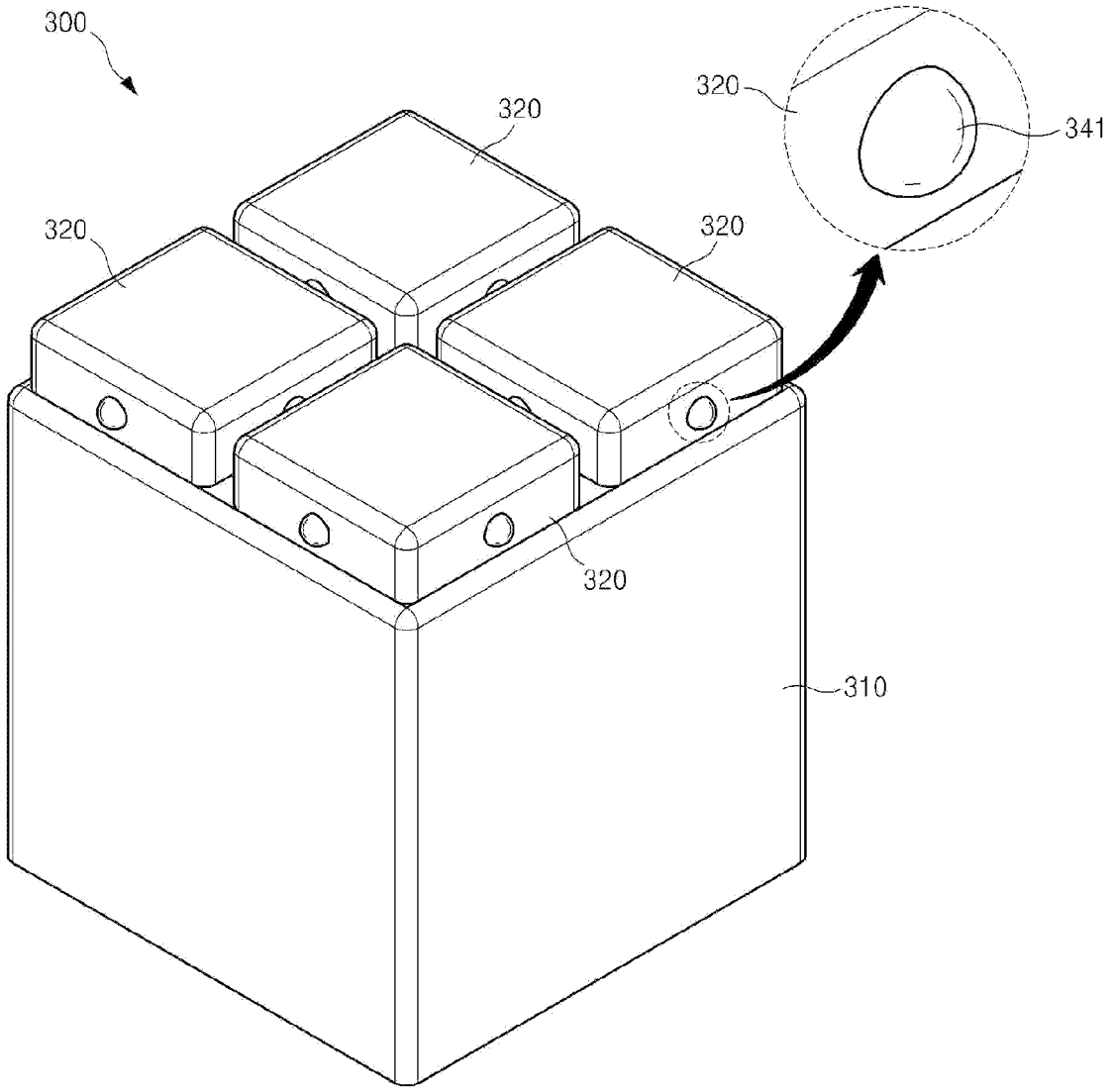
FIG. 10 is a front perspective view of a block studying tool for an infant according to a third embodiment of the present invention.

FIG. 10 is a front perspective view of a block studying tool for an infant according to a third embodiment of the present invention.

Referring to FIG. 10, a block studying tool 300 for an infant according to the present embodiment also has a structure in which a plurality of unit assembling portions 320 having the same shape and disposed to be spaced apart from each other are integrally formed at an upper portion of a block body 310 having a hexahedral shape, an inside of which is empty.

In this structure, outer assembling protrusions 341 are formed in the form of hemispheres, unlike in the above-described embodiment.

Even when the block studying tool 300 for the infant according to the present embodiment is applied, a simple stacking play in a straight line and a slantly-stacking play can be performed so that sculptures having various shapes can be assembled. Also, assembling and disassembling can be easily performed so that the infant can perform a stacking play without getting irritated. Thus, the infant's ability to think and inquiry skills can be improved, and attentiveness, an ability to observe, organizing power, understanding, creativity, and practical ability, which are required for infants' cognitive development, can be improved.

Figure 11:
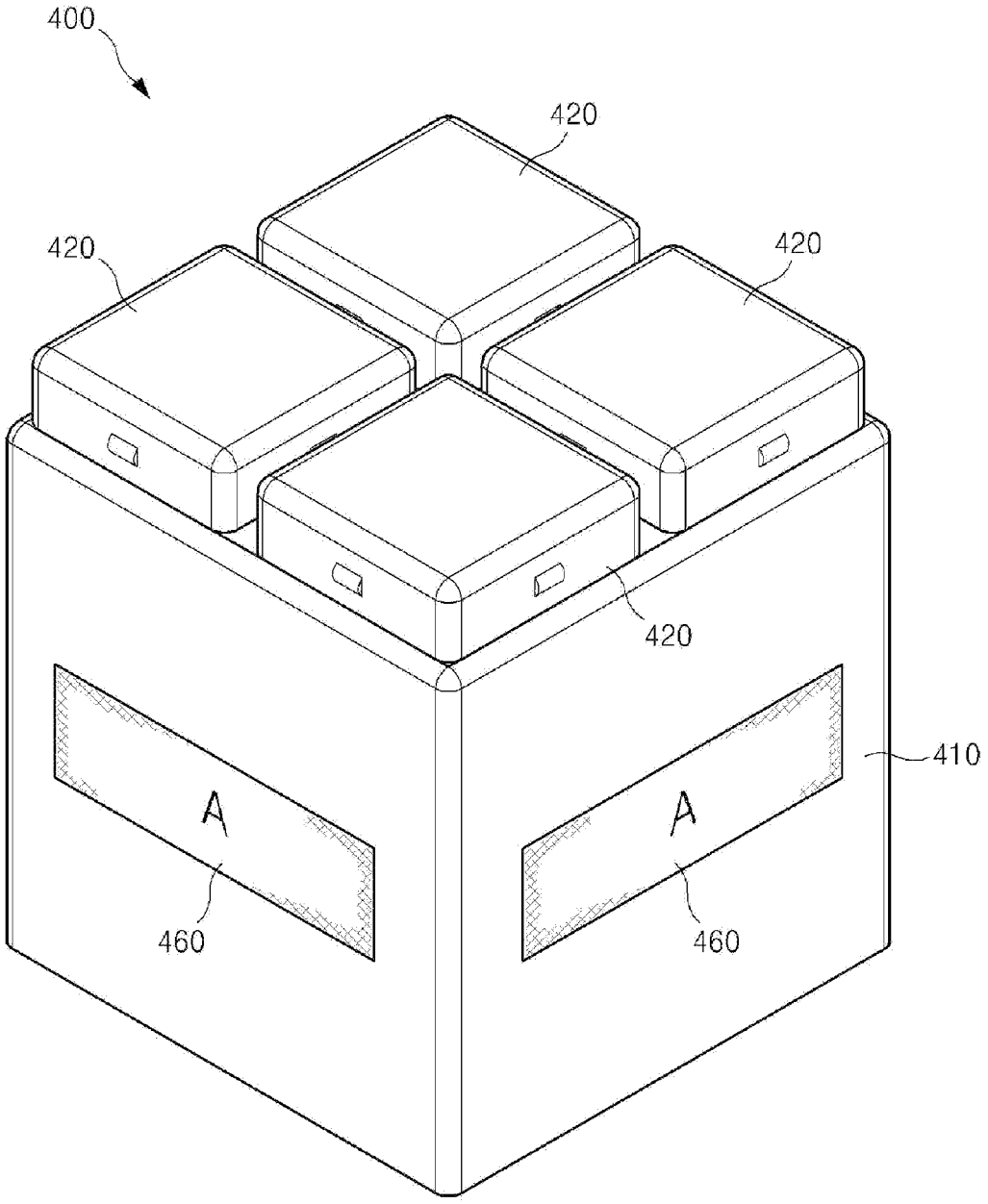
FIG. 11 is a front perspective view of a block studying tool for an infant according to a fourth embodiment of the present invention.
Figure 12:
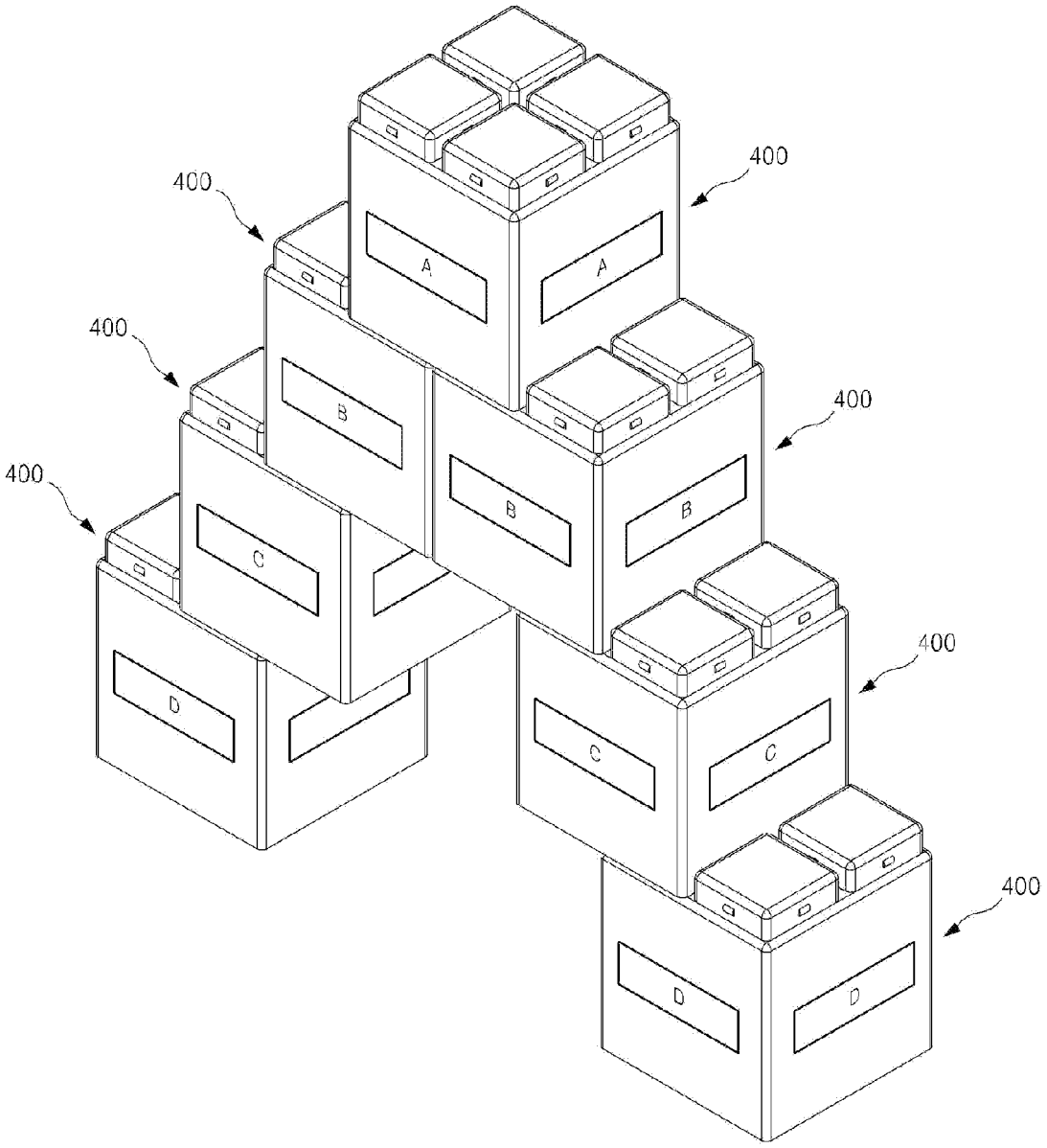
FIG. 12 is a view of sculptures assembled using the block studying tool for the infant illustrated in FIG. 11.

FIG. 11 is a front perspective view of a block studying tool for an infant according to a fourth embodiment of the present invention, and FIG. 12 is a view of sculptures assembled using the block studying tool for the infant illustrated in FIG. 11.

Referring to FIGS. 11 and 12, a block studying tool 400 for an infant according to the present embodiment also has a structure in which a plurality of unit assembling portions 420 having the same shape and disposed to be spaced apart from each other are integrally formed at an upper portion of a block body 410 having a hexahedral shape, an inside of which is empty.

In this structure, identification patterns 460 are printed on sides of the block body 410. In the present embodiment, the identification patterns 460 may be English letters.

In this way, the structure of the block studying tool 400 for the infant is the same as the above-described embodiment. However, when the identification patterns 460 are formed on the sides of the block body 410, an enhanced learning play in which English letters can be arranged in order while block stacking is performed, as illustrated in FIG. 12, can be performed.

Even when the block studying tool 400 for the infant according to the present embodiment is applied, a simple stacking play in a straight line and a slantly-stacking play can be performed so that sculptures having various shapes can be assembled. Also, assembling and disassembling can be easily performed so that the infant can perform a stacking play without getting irritated. Thus, the infant's ability to think and inquiry skills can be improved, and attentiveness, an ability to observe, organizing power, understanding, creativity, and practical ability, which are required for infants' cognitive development, can be improved.

Figure 13:
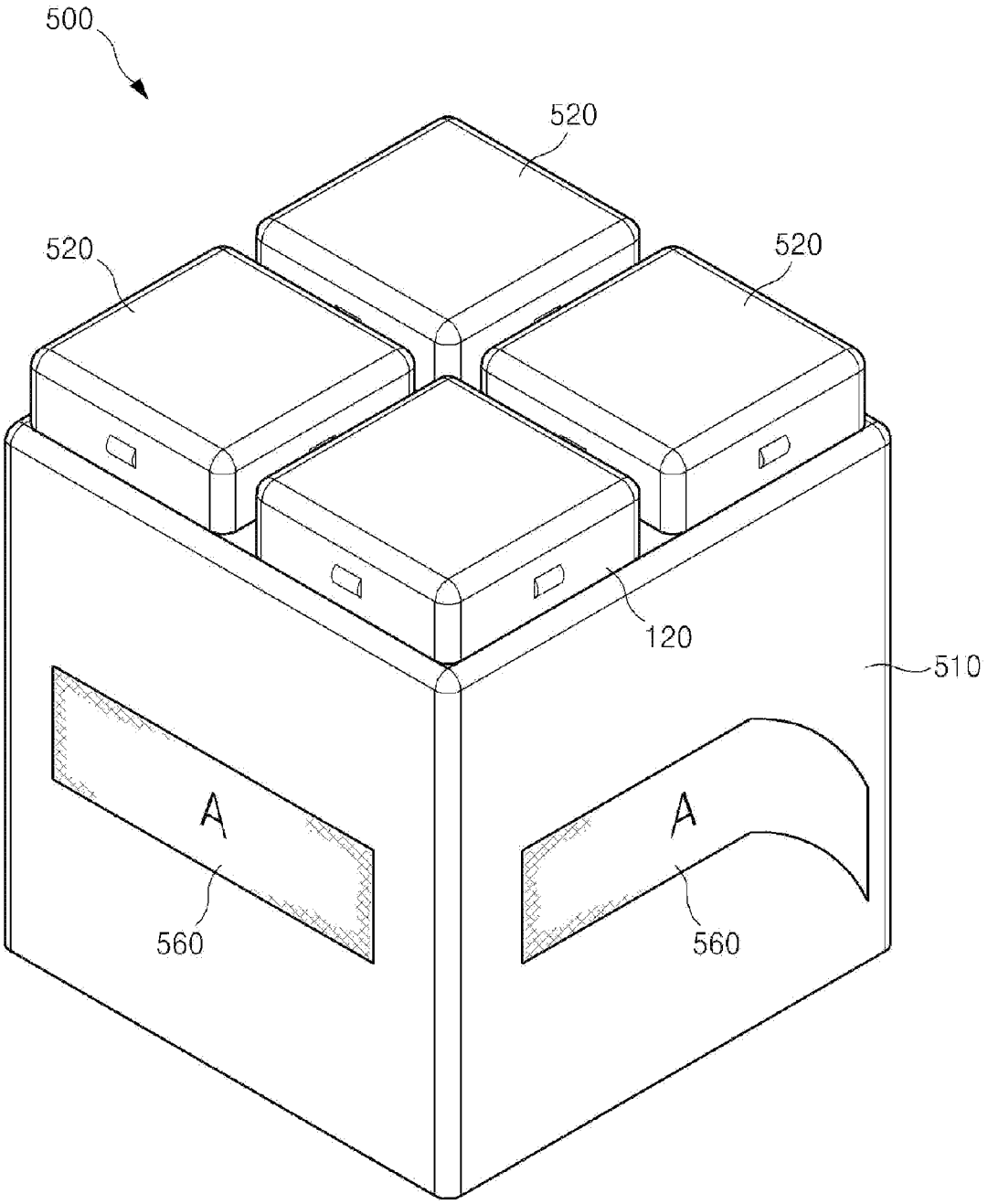
FIG. 13 is a front perspective view of a block studying tool for an infant according to a fifth embodiment of the present invention.

FIG. 13 is a front perspective view of a block studying tool for an infant according to a fifth embodiment of the present invention.

Referring to FIG. 13, a block studying tool 500 for an infant according to the present embodiment also has a structure in which a plurality of unit assembling portions 520 having the same shape and disposed to be spaced apart from each other are integrally formed at an upper portion of a block body 510 having a hexahedral shape, an inside of which is empty.

In this structure, identification patterns 560 are printed on sides of the block body 510. In the present embodiment, the identification patterns 560 are applied in the form of tapes, unlike in a printing method of FIG. 11.

When, in the current embodiment, the identification patterns 560 are applied in the form of tapes, identification patterns (not shown) having other various shapes, such as numbers, Korean letters, and animal shapes, may be used.

Even when the block studying tool 500 for the infant according to the present embodiment is applied, a simple stacking play in a straight line and a slantly-stacking play can be performed so that sculptures having various shapes can be assembled. Also, assembling and disassembling can be easily performed so that the infant can perform a stacking play without getting irritated. Thus, the infant's ability to think and inquiry skills can be improved, and attentiveness, an ability to observe, organizing power, understanding, creativity, and practical ability, which are required for infants' cognitive development, can be improved.

As described above, according to the present invention, a simple stacking play in a straight line and a slantly-stacking play can be performed so that sculptures having various shapes can be assembled and assembling is neither too easy nor too difficult so that the educational effect can be doubled.

In addition, according to the present invention, assembling and disassembling can be easily performed so that an infant can perform a stacking play without getting irritated. Thus, infants' ability to think and inquiry skills can be improved, and attentiveness, an ability to observe, organizing power, understanding, creativity, and practical ability, which are required for infants' cognitive development, can be improved.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A block studying tool for an infant, comprising:

a block body having a hexahedral shape, a lower portion of which is opened; and a plurality of unit assembling portions disposed to protrude from an upper portion of the block body upward and disposed to be spaced a predetermined distance apart from each other, wherein a divider is disposed at an inside of the lower portion of the block body and forms an assembling space in which the plurality of unit assembling portions of the adjacent block body are to be assembled according to positions, wherein four unit assembling portions having a hexahedral shape are disposed to be spaced apart from each other, wherein outer assembling protrusions are formed to protrude from all of circumferential wall surfaces of the unit assembling portions, and outer assembling protrusion assembling grooves to be assembled with the outer assembling protrusions are formed in inner sidewalls of the lower portion of the block body, wherein a shape of each of the outer assembling protrusions is selected from the group consisting of a semi-pipe shape, a rectangular block shape, and a hemisphere shape, and wherein the outer assembling protrusion assembling grooves correspond to the outer assembling protrusions and are formed to have larger sizes than the outer assembling protrusions.

2. The block studying tool of claim 1, wherein protrusions for doubling assembling strength are formed on the divider of the block body and are inserted into a space between the unit assembling portions so as to double assembling strength.

3. The block studying tool of claim 1, wherein the divider is disposed in a cross shape, and a reinforcement center boss is formed at a central intersection point of the divider, reinforces the divider, and is disposed in empty spaces of center regions of the unit assembling portions.

4. The block studying tool of claim 1, wherein each of the unit assembling portions has the same shape and the same volume, and edge regions of each unit assembling portion are rounded.

* * * * *